US008820405B2

(12) United States Patent
Turner et al.

(10) Patent No.: US 8,820,405 B2
(45) Date of Patent: Sep. 2, 2014

(54) SEGREGATING FLOWABLE MATERIALS IN A WELL

(75) Inventors: Jay K. Turner, Humble, TX (US); James R. Lovorn, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 330 days.

(21) Appl. No.: 13/345,546

(22) Filed: Jan. 6, 2012

(65) Prior Publication Data

US 2012/0103610 A1 May 3, 2012

Related U.S. Application Data

(63) Continuation-in-part of application No. 13/084,841, filed on Apr. 12, 2011, now Pat. No. 8,201,628.

(30) Foreign Application Priority Data

Apr. 27, 2010 (WO) ..... PCT/US10/32578

(51) Int. Cl.
*E21B 33/13* (2006.01)
*E21B 21/08* (2006.01)

(52) U.S. Cl.
CPC ..... *E21B 21/08* (2013.01); *E21B 33/13* (2013.01)
USPC ..... 166/292; 166/243; 166/285; 166/290; 175/72

(58) Field of Classification Search
USPC ..... 166/153, 192, 243, 285, 290, 291, 292, 166/294, 295, 300, 387; 175/57, 72
See application file for complete search history.

(56) References Cited

U.S. PATENT DOCUMENTS 2,223,397 A 12/1940 White et al.
3,603,409 A 9/1971 Watkins
4,046,191 A 9/1977 Neath (Continued)

FOREIGN PATENT DOCUMENTS

EP 1432887 B1 3/2003
EP 1488073 B1 8/2003

(Continued)

OTHER PUBLICATIONS

International Search Report and Written Opinion issued Feb. 12, 2009, for International Patent Application No. PCT/US08/87686, 7 pages.

(Continued)

*Primary Examiner* — George Suchfield
(74) *Attorney, Agent, or Firm* — Smith IP Services, P.C.

(57) ABSTRACT

A method of segregating flowable materials in conjunction with a subterranean well can include segregating flowable cement from a fluid by placing a flowable barrier substance between the cement and the fluid, and the barrier substance substantially preventing displacement of the cement by force of gravity through the barrier substance and into the fluid. Another method of segregating flowable materials can include flowing a barrier substance into a wellbore above a fluid already in the wellbore, and then flowing cement into the wellbore above the barrier substance. A system for use in conjunction with a subterranean well can include a flowable cement isolated from a fluid by a flowable barrier substance positioned between the cement and the fluid, whereby the barrier substance substantially prevents displacement of the cement by force of gravity through the barrier substance and into the fluid.

29 Claims, 5 Drawing Sheets

(56) References Cited

U.S. PATENT DOCUMENTS 4,063,602 A 12/1977 Howell et al.
4,083,407 A * 4/1978 Griffin et al. ..... 166/291
4,099,583 A 7/1978 Maus
4,194,567 A 3/1980 Marais
4,275,788 A * 6/1981 Sweatman ..... 166/292
4,291,772 A 9/1981 Beynet
4,387,770 A * 6/1983 Hill ..... 166/305.1
4,468,056 A 8/1984 Kramer et al.
4,626,135 A 12/1986 Roche
4,627,496 A * 12/1986 Ashford et al. ..... 166/292
4,813,495 A 3/1989 Leach
4,819,727 A 4/1989 Jennings, Jr.
4,880,060 A 11/1989 Schwendemann et al.
4,924,942 A * 5/1990 Shen ..... 166/291
5,006,845 A 4/1991 Calcar
5,027,900 A 7/1991 Wilson
5,188,176 A 2/1993 Carpenter
5,327,973 A 7/1994 Jennings, Jr.
5,332,040 A 7/1994 Nahm et al.
5,346,011 A 9/1994 Onan et al.
5,402,849 A 4/1995 Jennings, Jr.
5,483,986 A 1/1996 Onan et al.
5,484,018 A 1/1996 Cavender et al.
5,529,123 A * 6/1996 Carpenter et al. ..... 166/293
5,697,441 A 12/1997 Vercaemer et al.
5,720,356 A 2/1998 Gardes
5,771,971 A 6/1998 Horton et al.
5,771,974 A 6/1998 Stewart et al.
6,047,773 A 4/2000 Zeltmann et al.
6,053,252 A 4/2000 Edwards
6,065,550 A 5/2000 Gardes
6,102,673 A 8/2000 Mott et al.
6,138,774 A 10/2000 Bourgoyne, Jr. et al.
6,145,591 A 11/2000 Boncan et al.
6,173,768 B1 1/2001 Watson
6,230,824 B1 5/2001 Peterman et al.
6,263,982 B1 7/2001 Hannegan et al.
6,273,193 B1 8/2001 Hermann et al.
6,325,159 B1 12/2001 Peterman et al.
6,328,107 B1 12/2001 Maus
6,450,262 B1 9/2002 Regan
6,454,022 B1 9/2002 Sangesland et al.
6,457,540 B2 10/2002 Gardes
6,470,975 B1 10/2002 Bourgoyne et al.
6,527,062 B2 3/2003 Elkins et al.
6,571,873 B2 6/2003 Maus
6,598,682 B2 7/2003 Johnson et al.
6,662,110 B1 12/2003 Bargach et al.
6,668,943 B1 12/2003 Maus et al.
6,732,798 B2 5/2004 Johnson et al.
6,732,804 B2 5/2004 Hosie et al.
6,739,397 B2 5/2004 Ayling
6,745,857 B2 6/2004 Gjedebo
6,802,379 B2 10/2004 Dawson et al.
6,814,140 B2 11/2004 Robichaux
6,820,702 B2 11/2004 Niedermayr et al.
6,840,322 B2 1/2005 Haynes et al.
6,854,532 B2 2/2005 Fincher et al.
6,892,812 B2 5/2005 Niedermayr et al.
6,904,981 B2 6/2005 Van Riet
6,913,092 B2 7/2005 Bourgoyne et al.
6,920,085 B2 7/2005 Finke et al.
6,981,561 B2 1/2006 Krueger et al.
7,023,691 B1 4/2006 Feight et al.
7,032,691 B2 4/2006 Humphreys
7,044,237 B2 5/2006 Leuchtenberg
7,055,627 B2 6/2006 Fontana et al.
7,073,591 B2 7/2006 Massie et al.
7,080,685 B2 7/2006 Bailey et al.
7,090,036 B2 8/2006 DeBoer
7,093,662 B2 8/2006 De Boer
7,096,975 B2 8/2006 Aronstam et al.
7,114,571 B2 10/2006 Gatherar et al.
7,134,489 B2 11/2006 Van Riet
7,158,886 B2 1/2007 Hou et al.
7,159,669 B2 1/2007 Bourgoyne et al.
7,174,975 B2 2/2007 Krueger et al.
7,185,718 B2 3/2007 Gardes
7,185,719 B2 3/2007 Van Riet
7,201,231 B2 4/2007 Chaplin et al.
7,207,399 B2 4/2007 Duhe et al.
7,237,613 B2 7/2007 Radi et al.
7,237,623 B2 7/2007 Hannegan
7,258,171 B2 8/2007 Bourgoyne et al.
7,258,174 B2 * 8/2007 Gjedrem ..... 175/22
7,264,058 B2 9/2007 Fossli
7,270,185 B2 9/2007 Fontana et al.
7,278,496 B2 10/2007 Leuchtenberg
7,281,593 B2 10/2007 Steiner et al.
7,350,597 B2 4/2008 Reitsma et al.
7,353,887 B2 4/2008 Krueger et al.
7,367,410 B2 5/2008 Sangesland
7,367,411 B2 5/2008 Leuchtenberg
7,395,878 B2 7/2008 Reitsma et al.
7,497,266 B2 3/2009 Fossli
7,513,310 B2 4/2009 Fossli
7,562,723 B2 7/2009 Reitsma
7,650,950 B2 1/2010 Leuchtenberg
7,658,228 B2 2/2010 Moksvold
7,677,329 B2 3/2010 Stave
7,708,064 B2 5/2010 Sehsah
7,721,822 B2 5/2010 Krueger et al.
7,740,067 B2 6/2010 Bour et al.
7,762,329 B1 7/2010 Morgan et al.
7,806,203 B2 10/2010 Krueger et al.
7,913,774 B2 3/2011 Partouche
7,926,593 B2 4/2011 Bailey et al.
8,201,628 B2 * 6/2012 Lovorn et al. ..... 166/292
2002/0092655 A1 7/2002 Fincher et al.
2002/0108783 A1 8/2002 Elkins et al.
2002/0112888 A1 8/2002 Leuchtenberg
2003/0066650 A1 4/2003 Fontana et al.
2003/0089498 A1 5/2003 Johnson et al.
2003/0098181 A1 5/2003 Aronstam et al.
2003/0111799 A1 6/2003 Gilmore
2003/0127230 A1 7/2003 Von Eberstein, Jr. et al.
2003/0139916 A1 7/2003 Choe et al.
2003/0170077 A1 9/2003 Herd et al.
2003/0220742 A1 11/2003 Niedermayr et al.
2004/0040746 A1 3/2004 Niedermayr et al.
2004/0124008 A1 7/2004 Fincher et al.
2004/0178001 A1 9/2004 Bourgoyne et al.
2004/0206548 A1 10/2004 Aronstam et al.
2005/0061546 A1 3/2005 Hannegan
2005/0067162 A1 * 3/2005 Gjedrem ..... 166/277
2005/0092522 A1 5/2005 Humphreys
2005/0092523 A1 5/2005 McCaskill et al.
2006/0006004 A1 1/2006 Terry et al.
2006/0021755 A1 2/2006 Radi et al.
2006/0065402 A9 3/2006 Fontana et al.
2006/0070772 A1 4/2006 De Boer
2006/0086538 A1 4/2006 Van Riet
2006/0102350 A1 5/2006 Bour et al.
2006/0102387 A1 5/2006 Bourgoyne et al.
2006/0124300 A1 6/2006 Steiner et al.
2006/0169491 A1 8/2006 Fossli
2006/0185857 A1 8/2006 York et al.
2006/0191716 A1 8/2006 Humphreys
2006/0207795 A1 9/2006 Kinder et al.
2006/0272860 A1 12/2006 Sweatman et al.
2007/0068704 A1 3/2007 Krueger et al.
2007/0168056 A1 7/2007 Shayegi et al.
2007/0240875 A1 10/2007 Van Riet
2007/0278007 A1 12/2007 Krueger et al.
2008/0041149 A1 2/2008 Leuchtenberg
2008/0060846 A1 3/2008 Belcher et al.
2008/0105434 A1 5/2008 Orbell et al.
2008/0223596 A1 9/2008 Ezell et al.
2008/0227665 A1 9/2008 Ezell et al.
2009/0032257 A1 2/2009 Rayssiguier et al.
2009/0139724 A1 6/2009 Gray et al.
2009/0211239 A1 8/2009 Askeland
2010/0006297 A1 1/2010 Stave
2010/0018715 A1 1/2010 Orbell et al.

(56) References Cited

U.S. PATENT DOCUMENTS

| | | | |
|---|---|---|---|
| 2011/0009298 | A1 | 1/2011 | Dobson, Jr. et al. |
| 2011/0094746 | A1 | 4/2011 | Allison et al. |
| 2011/0259612 | A1 | 10/2011 | Lovorn et al. |
| 2011/0290562 | A1 | 12/2011 | Standifird et al. |

FOREIGN PATENT DOCUMENTS

| | | | |
|---|---|---|---|
| EP | 1240404 | B1 | 12/2003 |
| EP | 1595057 | B1 | 9/2004 |
| EP | 1071862 | B1 | 11/2004 |
| EP | 1664478 | B1 | 2/2005 |
| EP | 1356186 | B1 | 6/2005 |
| EP | 2053196 | A1 | 4/2009 |
| WO | 9942696 | A1 | 8/1999 |
| WO | 01/65060 | A1 | 9/2001 |
| WO | 0183941 | A1 | 11/2001 |
| WO | 0190528 | A1 | 11/2001 |
| WO | 02/50398 | A1 | 6/2002 |
| WO | 0244518 | A1 | 6/2002 |
| WO | 03025334 | A8 | 3/2003 |
| WO | 03025336 | A1 | 3/2003 |
| WO | 03071091 | A9 | 8/2003 |
| WO | 2004005667 | A1 | 1/2004 |
| WO | 2004074627 | A1 | 9/2004 |
| WO | 2004085788 | A3 | 10/2004 |
| WO | 2005001237 | A1 | 1/2005 |
| WO | 2005017308 | A1 | 2/2005 |
| WO | 2005/042917 | A1 | 5/2005 |
| WO | 2006029379 | A1 | 3/2006 |
| WO | 2006031119 | A1 | 3/2006 |
| WO | 2006099362 | A1 | 9/2006 |
| WO | 2006118920 | A3 | 11/2006 |
| WO | 2006138565 | A1 | 12/2006 |
| WO | 2007/008085 | A1 | 1/2007 |
| WO | 2007008085 | A1 | 1/2007 |
| WO | 2007016000 | A1 | 2/2007 |
| WO | 2007030017 | A1 | 3/2007 |
| WO | 2007081711 | A3 | 7/2007 |
| WO | 2007112291 | A3 | 10/2007 |
| WO | 2007124330 | A3 | 11/2007 |
| WO | 2008133523 | A1 | 11/2008 |
| WO | 2008134266 | A1 | 11/2008 |
| WO | 2008151128 | A9 | 12/2008 |
| WO | 2008156376 | A1 | 12/2008 |
| WO | 2009017418 | A1 | 2/2009 |
| WO | 2009018448 | A2 | 2/2009 |
| WO | 2009058706 | A2 | 5/2009 |
| WO | 2009086442 | A3 | 7/2009 |
| WO | 2009111412 | A1 | 9/2009 |
| WO | 2009123476 | A1 | 10/2009 |
| WO | 2010065646 | A3 | 6/2010 |
| WO | 2010095947 | A1 | 8/2010 |
| WO | 2011043764 | A1 | 4/2011 |

OTHER PUBLICATIONS

International Search Report and Written Opinion issued Sep. 22, 2008, for International Patent Application No. PCT/US07/83974, 16 pages.
International Preliminary Report on Patentability issued May 22, 2009, for International Patent Application Serial No. PCT/US07/83974, 13 pages.
International Search Report and Written Opinion issued Jan. 25, 2011, for International Patent Application Serial No. PCT/US10/032578, 9 pages.
Halliburton; "N-SOLATE Thermally Insulating Packer Fluid Systems", company slideshow, dated 2007, 22 pages.
Halliburton; "N-SOLATE Packer Fluids", H05923, dated Aug. 2008, 2 pages.
International Search Report and Written Opinion issued Apr. 26, 2013 for PCT Patent Application No. PCT/US2012/071574, 12 pages.
International Preliminary Report on Patentability issued Nov. 8, 2012 for US PCT Patent Application No. PCT/US2010/032578, 5 pages.
Australian Office Action issued Oct. 5, 2010 for AU Patent Application No. 2007317276, 2 pages.
International Search Report with Written Opinion issued Oct. 13, 2010 for PCT Patent Application No. PCT/US10/020122, 13 pages.
International Preliminary Report with Patentability issued Jun. 30, 2011 for PCT Patent Application No. PCT/US08/087686, 6 pages.
Office Action issued Sep. 16, 2011 for U.S. Appl. No. 12/299,411, 23 pages.
International Search Report with Written Opinion issued Nov. 21, 2011 for PCT Patent Application No. PCT/US11/036616, 13 pages.
International Search Report with Written Opinion issued Dec. 13, 2011 for PCT Patent Application No. PCT/US11/035751, 16 pages.
International Search Report with Written Opinion issued Dec. 21, 2011 for PCT Patent Application No. PCT/US11/031790, 15 pages.
Singapore Examination Report issued Dec. 27, 2011 for SG Patent Application No. 200903022-2, 8 pages.
Office Action issued Jan. 24, 2012 for U.S. Appl. No. 12/638,012, 18 pages.
U.S. Appl. No. 13/428,366, specification and drawings filed Mar. 19, 2012, 29 pages.
U.S. Appl. No. 13/423,384, specification and drawings filed Mar. 19, 2012, 29 pages.
U.S. Appl. No. 13/406,703, specification and drawings filed Feb. 28, 2012, 42 pages.
Pre-Interview First Office Action issued Jul. 14, 2010 for U.S. Appl. No. 11/936,411, 14 pages.
International Search Report with Written Opinion issued Jun. 17, 2011 for PCT Patent Application No. PCT/US10/056433, 9 pages.
Office Action issued Feb. 7, 2012 for U.S. Appl. No. 13/022,964, 15 page.
International Search Report with Written Opinion issued Feb. 8, 2012 for PCT Patent Application No. PCT/US11/031767, 9 pages.
International Preliminary Report on Patentability issued Feb. 9, 2012 for PCT Patent Application No. PCT/US09/052227, 7 pages.
IRIS; "Automatic Coordination of Equipment while Circulating out a Kick and Displacing the Kill-Weight Mud", IADC Well Control Europe, dated 2010, 41 pages.
Office Action issued Mar. 14, 2012 for U.S. Appl. No. 12/299,411, 36 pages.
FAIPP Office Action issued Jul. 14, 2010 for U.S. Appl. No. 11/936,411, 16 pages.
PI Office Action issued Jul. 29, 2010 for U.S. Appl. No. 11/936,411, 3 pages.
Office Action issued Feb. 25, 2011 for U.S. Appl. No. 11/936,411, 66 pages.
Written Opinion issued May 17, 2010, for SG Patent Application Serial No. 2009030222, 2 pages.
GE Oil & Gas; "Hydril Pressure Control K Pulsation Dampers", product information, dated Aug. 6, 2010, 2 pages.
Chinese Office Action issued Feb. 22, 2012 for CN Patent Application No. 200780049409.0, 7 pages.
English Translation of Chinese Office Action issued Feb. 22, 2012 for CN Patent Application No. 200780049409.0, 7 pages.
Weatherford International Ltd.; "Weatherford Model 7800 Rotating Control Device", article No. 4593.00, dated 2007, 5 pages.
Weatherford International Ltd.; "Model 7875 Rotating Control Device", article No. 4594.01, dated 2010, 4 pages.
Hannegan, Don; Weatherford International; "Offshore Drilling Hazard Mitigation: Controlled Pressure Drilling Redefines What is Drillable", Managed Pressure Drilling Magazine, Drilling Contractor article, dated Jan.- Feb. 2009, 4 pages.
Smith Services; "Hold 2500 Rotating Control Device", product brochure, article No. ss-04-0055, dated 2004, 4 pages.
Smith Services; "Marine Riser RCD", product presentation, dated Jul. 2009, 18 pages.
Singapore Written Opinion issued May 17, 2010 for SG Patent Application No. 2009030222, 10 pages.
Pre-Interview First Office Action issued Jul. 29, 2010 for U.S. Appl. No. 11/936,411, 3 pages.
Singapore Office Action issued Feb. 15, 2011 for SG Patent Application No. 200903022, 9 pages.
Australian Examiner's Report issued Mar. 7, 2011 for AU Patent Application No. 2007317276, 2 pages.

(56) References Cited

OTHER PUBLICATIONS

International Search Report and Written Opinion issued Jul. 27, 2011 for PCT Patent Application No. PCT/US2010/062394, 10 pages.
Halliburton; CFS-538, Product Data Sheet, dated 2011, 1 page.
Halliburton; "Baractive", Product Data Sheet, dated Sep. 3, 2010, 1 page.
Office Action issued Nov. 25, 2011 for U.S. Appl. No. 13/084,841, 19 page.
Specification and Drawings for U.S. Appl. No. 13/457,108, filed Apr. 16, 2012, 37 pages.
Supplementary European Search Report issued May 13, 2013 for European Patent Application No. 10850856.5, 9 pages.
Hyne, Norman J. "Dictionary of Petroleum Exploration, Drilling, & Production", Book, Jan. 1, 1990, p. 478, PennWell Books, Tulsa, Oklahoma.
US 6,708,780, 03/2004, Bourgoyne et al. (withdrawn)

* cited by examiner

SEGREGATING FLOWABLE MATERIALS IN A WELL

CROSS-REFERENCE TO RELATED APPLICATIONS

This application is a continuation-in-part of U.S. application Ser. No. 13/084,841, filed 12 Apr. 2011, publication no. 2011/0259612, which claims priority under 35 USC 119 to International Application No. PCT/US10/32578 filed 27 Apr. 2010. The entire disclosures of these prior applications are incorporated herein by this reference.

BACKGROUND

The present disclosure relates generally to equipment and flowable materials utilized, and operations performed, in conjunction with a subterranean well and, in one example described below, more particularly provides for wellbore pressure control with segregated fluid columns.

In various different types of well operations, it can be beneficial to be able to isolate one flowable substance from another. In the past, this function has generally been performed by equipment, such as, plugs, packers, etc.

It will be appreciated that improvements are continually needed in the art of isolating flowable substances from one another. The improvements could be used in drilling, completion, abandonment and/or in other types of well operations.

DETAILED DESCRIPTION

Figure 1:
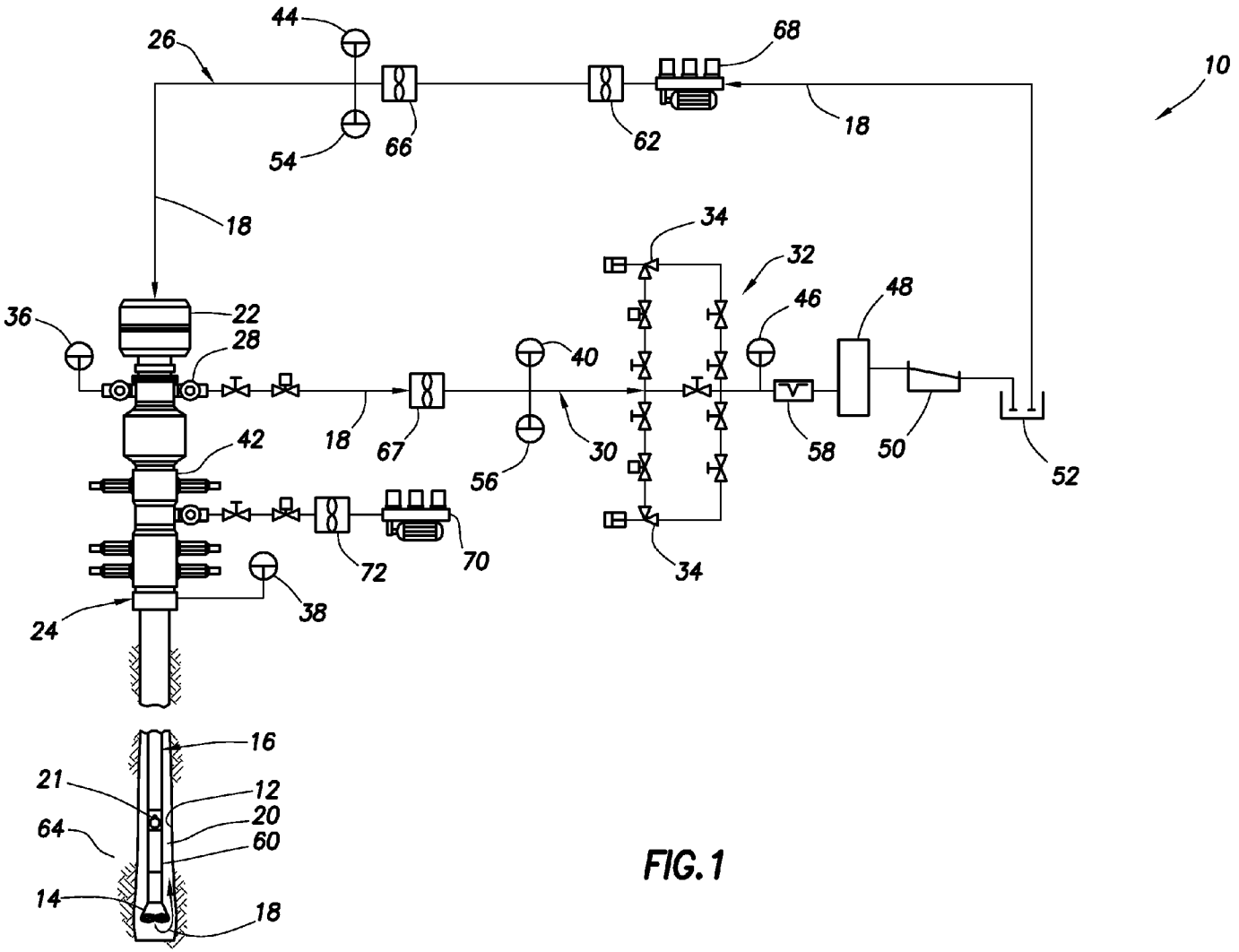
FIG. 1 is a representative partially cross-sectional view of a system and associated method which can embody principles of the present disclosure.

Representatively and schematically illustrated in FIG. 1 is a system 10 for use with a well, and an associated method, which system and method can embody principles of this disclosure. The FIG. 1 example is configured for underbalanced or managed pressure drilling, but it should be clearly understood that this is merely one example of a well operation which can embody principles of this disclosure.

In the system 10, a wellbore 12 is drilled by rotating a drill bit 14 on an end of a tubular string 16. Drilling fluid 18, commonly known as mud, is circulated downward through the tubular string 16, out the drill bit 14 and upward through an annulus 20 formed between the tubular string and the wellbore 12, in order to cool the drill bit, lubricate the tubular string, remove cuttings and provide a measure of bottom hole pressure control. A non-return valve 21 (typically a flapper-type check valve) prevents flow of the drilling fluid 18 upward through the tubular string 16 (e.g., when connections are being made in the tubular string).

Control of bottom hole pressure is very important in managed pressure and underbalanced drilling, and in other types of well operations. Preferably, the bottom hole pressure is accurately controlled to prevent excessive loss of fluid into an earth formation 64 surrounding the wellbore 12, undesired fracturing of the formation, undesired influx of formation fluids into the wellbore, etc.

In typical managed pressure drilling, it is desired to maintain the bottom hole pressure just greater than a pore pressure of the formation 64, without exceeding a fracture pressure of the formation. In typical underbalanced drilling, it is desired to maintain the bottom hole pressure somewhat less than the pore pressure, thereby obtaining a controlled influx of fluid from the formation 64.

Nitrogen or another gas, or another lighter weight fluid, may be added to the drilling fluid 18 for pressure control. This technique is especially useful, for example, in underbalanced drilling operations.

In the system 10, additional control over the bottom hole pressure is obtained by closing off the annulus 20 (e.g., isolating it from communication with the atmosphere and enabling the annulus to be pressurized at or near the surface) using a rotating control device 22 (RCD). The RCD 22 seals about the tubular string 16 above a wellhead 24. Although not shown in FIG. 1, the tubular string 16 would extend upwardly through the RCD 22 for connection to, for example, a rotary table (not shown), a standpipe line 26, kelley (not shown), a top drive and/or other conventional drilling equipment.

The drilling fluid 18 exits the wellhead 24 via a wing valve 28 in communication with the annulus 20 below the RCD 22. The fluid 18 then flows through fluid return line 30 to a choke manifold 32, which includes redundant chokes 34. Backpressure is applied to the annulus 20 by variably restricting flow of the fluid 18 through the operative choke(s) 34.

The greater the restriction to flow through the choke 34, the greater the backpressure applied to the annulus 20. Thus, bottom hole pressure can be conveniently regulated by varying the backpressure applied to the annulus 20. A hydraulics model can be used, as described more fully below, to determine a pressure applied to the annulus 20 at or near the surface which will result in a desired bottom hole pressure, so that an operator (or an automated control system) can readily determine how to regulate the pressure applied to the annulus at or near the surface (which can be conveniently measured) in order to obtain the desired bottom hole pressure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the fluid return line 30 upstream of the choke manifold 32.

Another pressure sensor 44 senses pressure in the standpipe line 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 66.

Not all of these sensors are necessary. For example, the system 10 could include only one of the flowmeters 62, 66. However, input from the sensors is useful to the hydraulics model in determining what the pressure applied to the annulus 20 should be during the drilling operation.

In addition, the tubular string 16 may include its own sensors 60, for example, to directly measure bottom hole pressure. Such sensors 60 may be of the type known to those skilled in the art as pressure while drilling (PWD), measurement while drilling (MWD) and/or logging while drilling (LWD) sensor systems. These tubular string sensor systems generally provide at least pressure measurement, and may also provide temperature measurement, detection of tubular string characteristics (such as vibration, weight on bit, stick-slip, etc.), formation characteristics (such as resistivity, density, etc.) and/or other measurements. Various forms of telemetry (acoustic, pressure pulse, electromagnetic, optical, wired, etc.) may be used to transmit the downhole sensor measurements to the surface.

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc.

Fewer sensors could be included in the system 10, if desired. For example, the output of the rig mud pump 68 could be determined by counting pump strokes, instead of by using flowmeter 62 or any other flowmeters.

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe line 26 and into the interior of the tubular string 16 by the rig mud pump 68. The pump 68 receives the fluid 18 from the mud pit 52 and flows it via a standpipe manifold (not shown) to the standpipe line 26, the fluid then circulates downward through the tubular string 16, upward through the annulus 20, through the mud return line 30, through the choke manifold 32, and then via the separator 48 and shaker 50 to the mud pit 52 for conditioning and recirculation.

Note that, in the system 10 as so far described above, the choke 34 cannot be used to control backpressure applied to the annulus 20 for control of the bottom hole pressure, unless the fluid 18 is flowing through the choke. In conventional overbalanced drilling operations, a lack of circulation can occur whenever a connection is made in the tubular string 16 (e.g., to add another length of drill pipe to the tubular string as the wellbore 12 is drilled deeper), and the lack of circulation will require that bottom hole pressure be regulated solely by the density of the fluid 18.

In the system 10, however, flow of the fluid 18 through the choke 34 can be maintained, even though the fluid does not circulate through the tubular string 16 and annulus 20. Thus, pressure can still be applied to the annulus 20 by restricting flow of the fluid 18 through the choke 34.

In the system 10 as depicted in FIG. 1, a backpressure pump 70 can be used to supply a flow of fluid to the return line 30 upstream of the choke manifold 32 by pumping fluid into the annulus 20 when needed. Alternatively, or in addition, fluid could be diverted from the standpipe manifold to the return line 30 when needed, as described in International Application Serial No. PCT/US08/87686, and in U.S. application Ser. No. 12/638,012. Restriction by the choke 34 of such fluid flow from the rig pump 68 and/or the backpressure pump 70 will thereby cause pressure to be applied to the annulus 20.

Although the example of FIG. 1 is depicted as if a drilling operation is being performed, it should be clearly understood that the principles of this disclosure may be utilized in a variety of other well operations. For example, such other well operations could include completion operations, logging operations, casing operations, etc.

Thus, it is not necessary for the tubular string 16 to be a drill string, or for the fluid 18 to be a drilling fluid. For example, the fluid 18 could instead be a completion fluid or any other type of fluid.

Accordingly, it will be appreciated that the principles of this disclosure are not limited to drilling operations and, indeed, are not limited at all to any of the details of the system 10 described herein and/or illustrated in the accompanying drawings.

Figure 2:
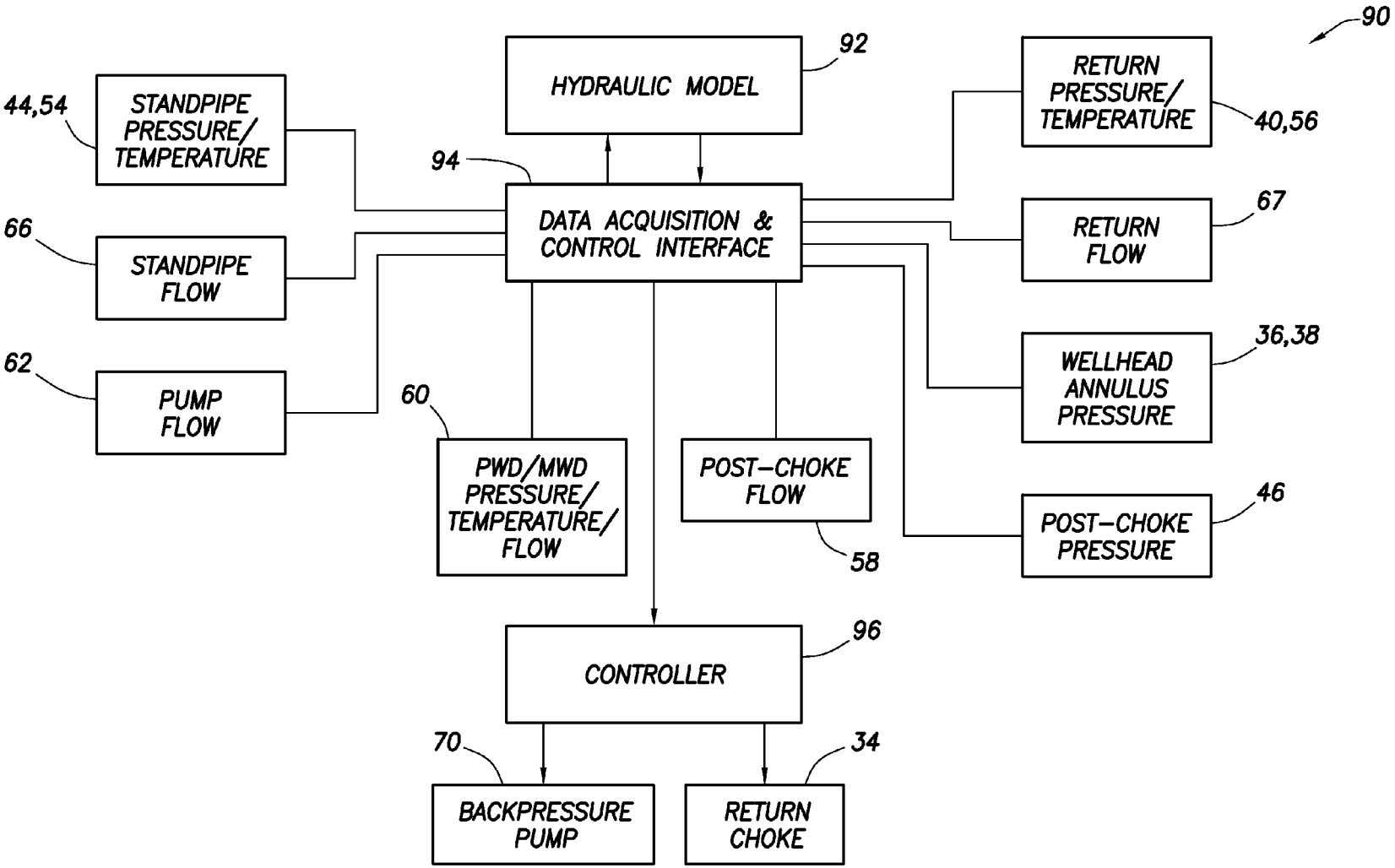
FIG. 2 is a representative view of a pressure and flow control system which may be used with the system and method of FIG. 1.

A pressure and flow control system 90 which may be used in conjunction with the system 10 and method of FIG. 1 is representatively illustrated in FIG. 2. The control system 90 is preferably fully automated, although some human intervention may be used, for example, to safeguard against improper operation, initiate certain routines, update parameters, etc.

The control system 90 includes a hydraulics model 92, a data acquisition and control interface 94 and a controller 96 (such as, a programmable logic controller or PLC, a suitably programmed computer, etc.). Although these elements 92, 94, 96 are depicted separately in FIG. 2, any or all of them could be combined into a single element, or the functions of the elements could be separated into additional elements, other additional elements and/or functions could be provided, etc.

The hydraulics model 92 is used in the control system 90 to determine the desired annulus pressure at or near the surface to achieve the desired bottom hole pressure. Data such as well geometry, fluid properties and offset well information (such as geothermal gradient and pore pressure gradient, etc.) are utilized by the hydraulics model 92 in making this determination, as well as real-time sensor data acquired by the data acquisition and control interface 94.

Thus, there is a continual two-way transfer of data and information between the hydraulics model 92 and the data acquisition and control interface 94. Preferably, the data acquisition and control interface 94 operates to maintain a substantially continuous flow of real-time data from the sensors 36, 38, 40, 44, 46, 54, 56, 58, 60, 62, 64, 66, 67 to the hydraulics model 92, so that the hydraulics model has the information it needs to adapt to changing circumstances and to update the desired annulus pressure. The hydraulics model 92 operates to supply the data acquisition and control interface 94 substantially continuously with a value for the desired annulus pressure.

A greater or lesser number of sensors may provide data to the interface 94, in keeping with the principles of this disclosure. For example, flow rate data from a flowmeter 72 which measures an output of the backpressure pump 70 may be input to the interface 94 for use in the hydraulics model 92.

A suitable hydraulics model for use as the hydraulics model 92 in the control system 90 is REAL TIME HYDRAULICS™ provided by Halliburton Energy Services, Inc. of Houston, Tex. USA. Another suitable hydraulics model is provided under the trade name IRIS™, and yet another is available from SINTEF of Trondheim, Norway. Any suitable hydraulics model may be used in the control system 90 in keeping with the principles of this disclosure.

A suitable data acquisition and control interface for use as the data acquisition and control interface 94 in the control system 90 are SENTRY™ and INSITE™ provided by Halliburton Energy Services, Inc. Any suitable data acquisition and control interface may be used in the control system 90 in keeping with the principles of this disclosure.

The controller 96 operates to maintain a desired setpoint annulus pressure by controlling operation of the fluid return choke 34 and/or the backpressure pump 70. When an updated desired annulus pressure is transmitted from the data acquisition and control interface 94 to the controller 96, the controller uses the desired annulus pressure as a setpoint and controls operation of the choke 34 in a manner (e.g., increasing or decreasing flow through the choke as needed) to maintain the setpoint pressure in the annulus 20.

This is accomplished by comparing the setpoint pressure to a measured annulus pressure (such as the pressure sensed by any of the sensors 36, 38, 40), and increasing flow through the choke 34 if the measured pressure is greater than the setpoint pressure, and decreasing flow through the choke if the measured pressure is less than the setpoint pressure. Of course, if the setpoint and measured pressures are the same, then no adjustment of the choke 34 is required. This process is preferably automated, so that no human intervention is required, although human intervention may be used if desired.

The controller 96 may also be used to control operation of the backpressure pump 70. The controller 96 can, thus, be used to automate the process of supplying fluid flow to the return line 30 when needed. Again, no human intervention may be required for this process.

Figure 3:
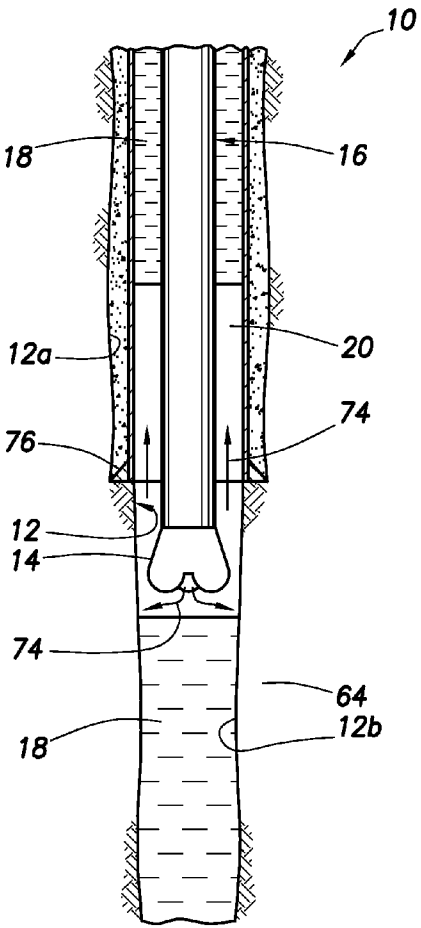
FIG. 3 is a representative cross-sectional view of the system in which initial steps of the method have been performed.

Referring additionally now to FIG. 3, a somewhat enlarged scale view of a portion of the well system 10 is representatively illustrated apart from the remainder of the system depicted in FIG. 1. In the FIG. 3 illustration, both cased 12*a* and uncased 12*b* sections of the wellbore 12 are visible.

In the example of FIG. 3, it is desired to trip the tubular string 16 out of the wellbore 12, for example, to change the bit 14, install additional casing, install a completion assembly, perform a logging operation, etc. However, it is also desired to prevent excessively increased pressure from being applied to the uncased section 12*b* of the wellbore exposed to the formation 64 (which could result in skin damage to the formation, fracturing of the formation, etc.), to prevent excessively reduced pressure from being exposed to the uncased section of the wellbore (which could result in an undesired influx of fluid into the wellbore, instability of the wellbore, etc.), to prevent any gas in the fluid 18 from migrating upwardly through the wellbore, and to prevent other fluids (such as higher density fluids) from contacting the exposed formation.

In one unique feature of the example depicted in FIG. 3, the tubular string 16 is partially withdrawn from the wellbore 12 (e.g., raised in the vertical wellbore shown in FIG. 3) and a barrier substance 74 is placed in the wellbore. The barrier substance 74 may be flowed into the wellbore 12 by circulating it through the tubular string 16 and into the annulus 20, or the barrier substance could be placed in the wellbore by other means (such as, via another tubular string installed in the wellbore, by circulating the barrier substance downward through the annulus, etc.).

As illustrated in FIG. 3, the barrier substance 74 is placed in the wellbore 12 so that it traverses the junction between the cased section 12*a* and uncased section 12*b* of the wellbore (i.e., at a casing shoe 76). However, in other examples, the barrier substance 74 could be placed entirely in the cased section 12*a* or entirely in the uncased section 12*b* of the wellbore 12.

The barrier substance 74 is preferably of a type which can isolate the fluid 18 exposed to the formation 64 from other fluids in the wellbore 12. However, the barrier substance 74 also preferably transmits pressure, so that control over pressure in the fluid 18 exposed to the formation 64 can be accomplished using the control system 90.

To isolate the fluid 18 exposed to the formation 64 from other fluids in the wellbore 12, the barrier substance 74 is preferably a highly viscous fluid, a highly thixotropic gel or a high strength gel which sets in the wellbore. However, the barrier substance 74 could be (or comprise) other types of materials in keeping with the principles of this disclosure.

Suitable highly thixotropic gels for use as the barrier substance 74 include N-SOLATE™ and CFS-538™ marketed by Halliburton Energy Services, Inc. A suitable preparation is as follows:

Water (freshwater)—0.85 bbl
Barite—203 lb/bbl
CFS-538™—9 lb/bbl

One suitable high strength gel for use as the barrier substance 74 may be prepared as follows:

BARACTIVE™ base fluid polar activator—0.7 bbl
Water (freshwater)—0.3 bbl
CFS-538™—10 lb/bbl Of course, a wide variety of different formulations may be used for the barrier substance 74. The above are only two such formulations, and it should be clearly understood that the principles of this disclosure are not limited at all to these formulations.

Figure 4:
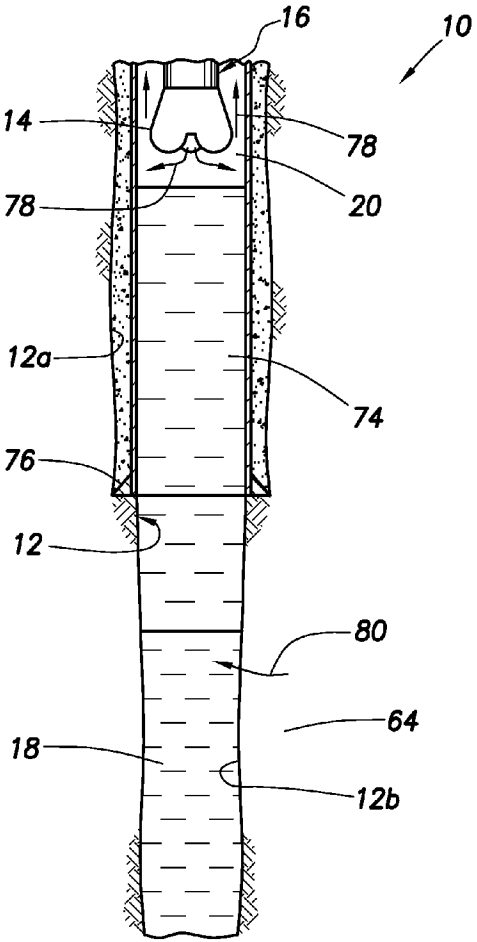
FIG. 4 is a representative cross-sectional view of the well system in which further steps of the method have been performed.

Referring additionally now to FIG. 4, the system 10 is representatively illustrated after the barrier substance 74 has been placed in the wellbore 12 and the tubular string 16 has been further partially withdrawn from the wellbore. Another fluid 78 is then flowed into the wellbore 12 on an opposite side of the barrier substance 74 from the fluid 18.

The fluid 78 preferably has a density greater than a density of the fluid 18. By flowing the fluid 78 into the wellbore 12 above the barrier substance 74 and the fluid 18, a desired pressure can be maintained in the fluid 18 exposed to the formation 64, as the tubular string 16 is tripped out of and back into the wellbore, as a completion assembly is installed, as a logging operation is performed, as casing is installed, etc.

The density of the fluid 78 is selected so that, after it is flowed into the wellbore 12 (e.g., filling the wellbore from the barrier substance 74 to the surface), an appropriate hydrostatic pressure will be thereby applied to the fluid 18 exposed to the formation 64. Preferably, at any selected location along the uncased section 12*b* of the wellbore 12, the pressure in the fluid 18 will be equal to, or only marginally greater than (e.g., no more than approximately 100 psi greater than), pore pressure in the formation 64. However, other pressures in the fluid 18 may be used in other examples.

While the barrier substance 74 is being placed in the wellbore 12, and while the fluid 78 is being flowed into the wellbore, the control system 90 preferably maintains the pressure in the fluid 18 exposed to the formation 64 substantially constant (e.g., varying no more than a few psi). The control system 90 can achieve this result by automatically adjusting the choke 34 as fluid exits the annulus 20 at the surface, as described above, so that an appropriate backpressure is applied to the annulus at the surface to maintain a desired pressure in the fluid 18 exposed to the formation 64.

Note that, since different density substances (e.g., barrier substance 74 and fluid 78) are being introduced into the wellbore 12, the annulus pressure setpoint will vary as the substances are introduced into the wellbore. Preferably, the density of the fluid 78 is selected so that, upon completion of the step of flowing the fluid 78 into the wellbore 12, no pressure will need to be applied to the annulus 20 at the surface in order to maintain the desired pressure in the fluid 18 exposed to the formation 64.

In this manner, a snubbing unit will not be necessary for subsequent well operations (such as, running casing, installing a completion assembly, wireline or coiled tubing logging, etc.). However, a snubbing unit may be used, if desired.

Preferably, the barrier fluid 74 will prevent mixing of the fluids 18, 78, will isolate the fluids from each other, will prevent migration of gas 80 upward through the wellbore 12, and will transmit pressure between the fluids. Consequently, excessively increased pressure in the uncased section 12*b* of the wellbore exposed to the formation 64 (which could otherwise result from opening a downhole deployment valve, etc.) can be prevented, excessively reduced pressure can be prevented from being exposed to the uncased section of the wellbore, gas in the fluid 18 can be prevented from migrating upwardly through the wellbore to the surface, and fluids (such as higher density fluids) other than the fluid 18 can be prevented from contacting the exposed formation.

Figure 5:
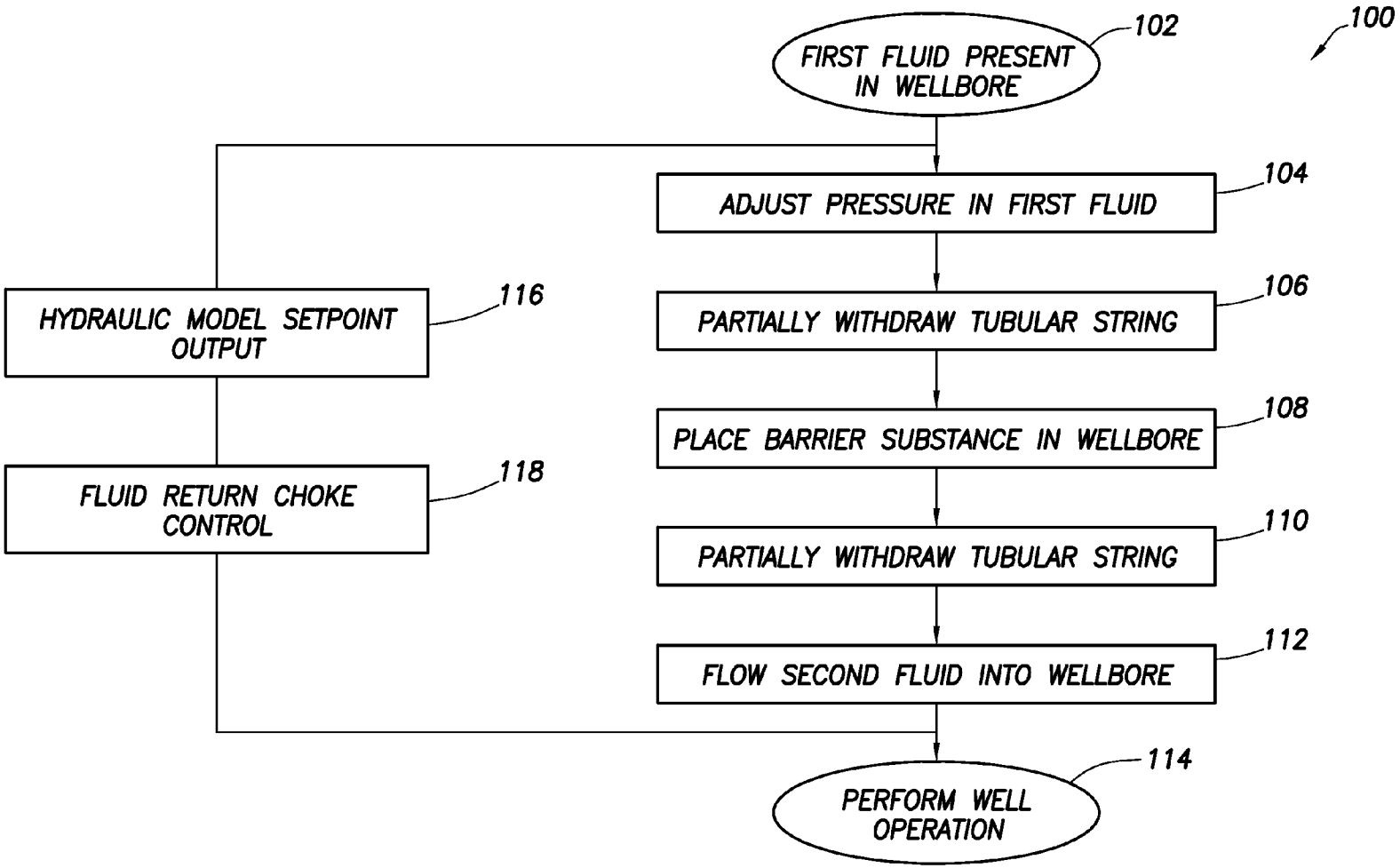
FIG. 5 is a representative view of a flowchart for the method.

Referring additionally now to FIG. 5, a flowchart for one example of a method 100 of controlling pressure in the wellbore 12 is representatively illustrated. The method 100 may be used in conjunction with the well system 10 described above, or the method may be used with other well systems.

In an initial step 102 of the method 100, a first fluid (such as the fluid 18) is present in the wellbore 12. As in the system 10, the fluid 18 could be a drilling fluid which is specially formulated to exert a desired hydrostatic pressure, prevent fluid loss to the formation 64, lubricate the bit 14, enhance wellbore stability, etc. In other examples, the fluid 18 could be a completion fluid or another type of fluid.

The fluid 18 may be circulated through the wellbore 12 during drilling or other operations. Various means (e.g., tubular string 16, a coiled tubing string, etc.) may be used to introduce the fluid 18 into the wellbore, in keeping with the principles of this disclosure.

In a subsequent step 104 of the method 100, pressure in the fluid 18 exposed to the formation 64 is adjusted, if desired. For example, if prior to beginning the procedure depicted in FIG. 5, an underbalanced drilling operation was being performed, then it may be desirable to increase the pressure in the fluid 18 exposed to the formation 64, so that the pressure in the fluid is equal to, or marginally greater than, pore pressure in the formation.

In this manner, an influx of fluid from the formation 64 into the wellbore 12 can be avoided during the remainder of the method 100. Of course, if the pressure in the fluid 18 exposed to the formation 64 is already at a desired level, then this step 104 is not necessary.

In step 106 of the method 100, the tubular string 16 is partially withdrawn from the wellbore 12. This places a lower end of the tubular string 16 at a desired lower extent of the barrier substance 74, as depicted in FIG. 3.

If the lower end of the tubular string 16 (or another tubular string used to place the barrier substance 74) was not previously below the desired lower extent of the barrier substance, then "partially withdrawing" the tubular string can be taken to mean, "placing the lower end of the tubular string at a desired lower extent of the barrier substance 74." For example, a coiled tubing string could be installed in the wellbore 12 for the purpose of placing the barrier substance 74 above the fluid 18 exposed to the formation 64, in which case the coiled tubing string could be considered "partially withdrawn" from the wellbore, in that its lower end would be positioned at a desired lower extent of the barrier substance.

In step 108 of the method 100, the barrier substance 74 is placed in the wellbore 12. As described above, the barrier substance could be flowed through the tubular string 16, flowed through the annulus 20 or placed in the wellbore by any other means.

In step 110 of the method 100, the tubular string 16 is again partially withdrawn from the wellbore 12. This time, the lower end of the tubular string 16 is positioned at a desired lower extent of the fluid 78. In this step 110, "partially withdrawing" can be taken to mean, "positioning a lower end of the tubular string at a desired lower extent of the fluid 78."

In step 112 of the method 100, the second fluid 78 is flowed into the wellbore 12. As described above, the fluid 78 has a selected density, so that a desired pressure is applied to the fluid 18 by the column of the fluid 78 thereabove. It is envisioned that, in most circumstances of underbalanced and managed pressure drilling, the density of the fluid 78 will be greater than the density of the fluid 18 (so that the pressure in the fluid 18 is equal to or marginally greater than the pressure in the formation 64), but in other examples the density of the fluid 78 could be equal to, or less than, the density of the fluid 18.

In step 114 of the method 100, a well operation is performed at the conclusion of the procedure depicted in FIG. 5. The well operation could be any type, number and/or combination of well operation(s) including, but not limited to, drilling operation(s), completion operation(s), logging operation (s), installation of casing, cementing operations, abandonment operations, etc. It is not necessary for the well operation to be managed or underbalanced drilling, or drilling of any type, in keeping with the scope of this disclosure. Preferably, due to the unique features of the system and method described herein, such operation(s) can be performed without use of a downhole deployment valve or a surface snubbing unit, but those types of equipment may be used, if desired, in keeping with the principles of this disclosure.

Throughout the method 100 example, and as indicated by steps 116 and 118 in FIG. 5, the hydraulics model 92 produces a desired surface annulus pressure setpoint as needed to maintain a desired pressure in the fluid 18 exposed to the formation 64, and the controller 96 automatically adjusts the choke 34 as needed to achieve the surface annulus pressure setpoint. The surface annulus pressure setpoint can change during the method 100.

For example, if the fluid 78 has a greater density than the fluid 18 in step 112, then the surface annulus pressure setpoint may decrease as the fluid 78 is flowed into the wellbore 12. As another example, in step 104, the surface annulus pressure setpoint may be increased if the wellbore 12 was previously being drilled underbalanced, and it is now desired to increase the pressure in the fluid 18 exposed to the formation 64, so that it is equal to or marginally greater than pressure in the formation.

Again, it is not necessary for the barrier substance 74 to be used in any type of drilling operation and/or managed pressure operation. The barrier substance 74 can separate fluids or other flowable substances in any type of well operation.

Note that, although in the above description only the fluids 18, 78 are indicated as being segregated by the barrier substance 74, in other examples more than one fluid could be exposed to the formation 64 below the barrier substance and/or more than one fluid may be positioned between the barrier substance and the surface. In addition, more than one barrier substance 74 and/or barrier substance location could be used in the wellbore 12 to thereby segregate any number of fluids.

Figure 6:
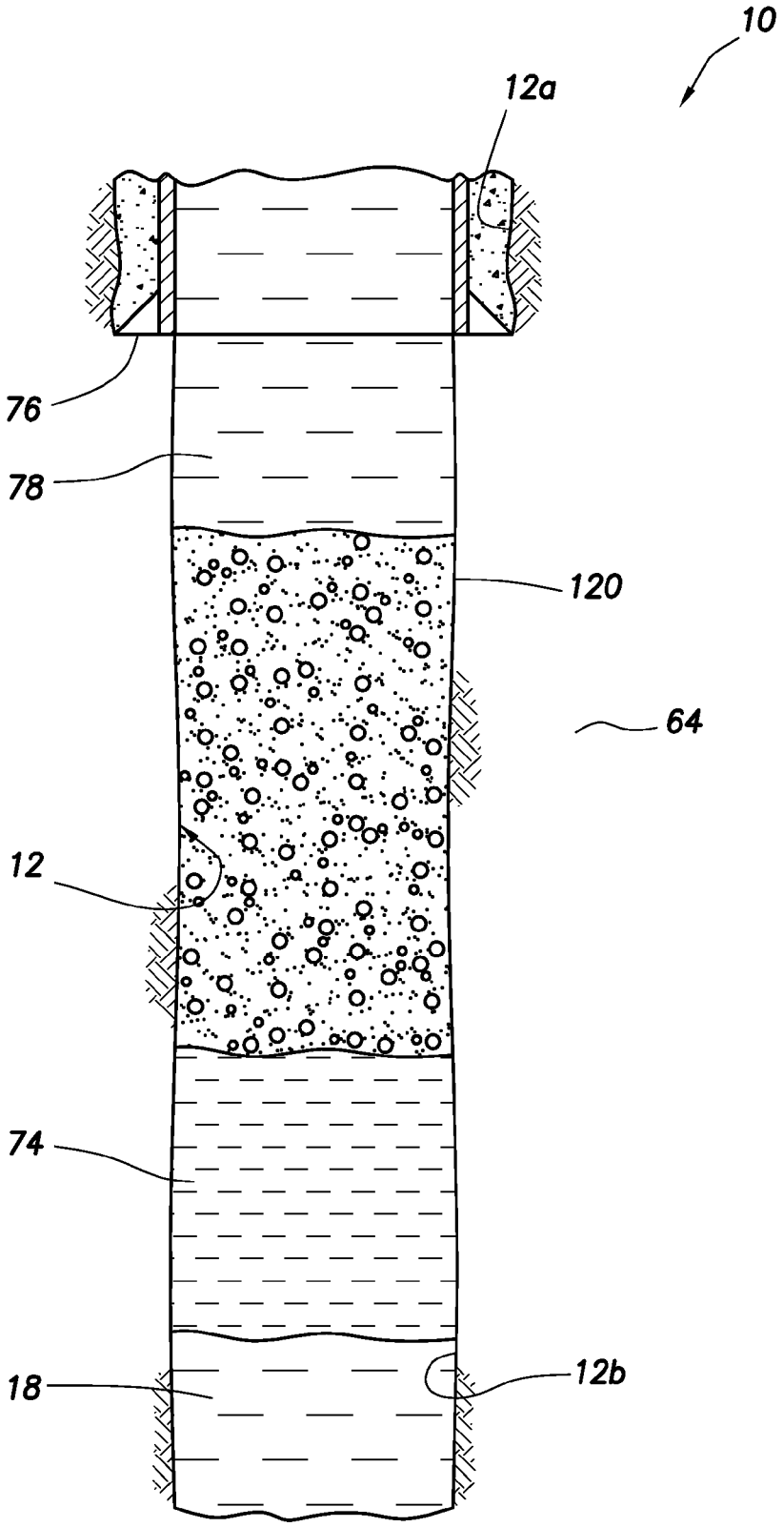
FIG. 6 is a representative cross-sectional view of another example of the system and method.

In an example representatively illustrated in FIG. 6, the barrier substance 74 isolates the fluid 18 from cement 120 placed in the uncased section 12*b* of the wellbore 12. The cement 120 is likely more dense than the fluid 18, but the barrier substance 74 prevents the cement 120 from penetrating the barrier substance and thereby flowing away from its intended location.

For example, it may be intended to place the cement 120 in a particularly stable and relatively impermeable zone, so that the cement will form an effective plug in the wellbore 12 (e.g., for abandonment of the well, for isolating a water-producing zone, for segregating zones, etc.). The effectiveness of the cement 120 as a plug could be compromised if the cement is allowed to fall downward through the fluid 18, to mix with the fluid 18, and/or to flow away from its intended placement.

In the system 10 as depicted in FIG. 6, the barrier substance 74 beneficially accomplishes the desired functions of preventing the cement 120 from falling through the fluid 18, preventing mixing of the cement and fluid 18, and maintaining the placement of the cement. These benefits are obtained, without a need to set an open hole bridge plug in the uncased section 12*b*. Instead, the barrier substance 74 can be conveniently placed above the fluid 18 (for example, using coiled tubing) prior to placing the cement 120 above the barrier fluid.

In addition, the barrier substance 74 transmits pressure between the cement 120 and the fluid 18. Thus, there is no concern that a pressure differential rating of an open hole bridge plug might be exceeded, and pressure in the fluid 18 can be effectively controlled by appropriate selection of the densities of the barrier substance 74, cement 120 and fluid 78 during the cementing operation.

The fluid 78 placed above the cement 120 could be the same as the fluid 18 below the barrier substance 74, and/or it could comprise another fluid having a density selected so that pressure in the wellbore 12 is maintained at a desired level. For example, the fluid 78 can be selected so that sufficient hydrostatic pressure in the wellbore 12 is maintained for well control (e.g., hydrostatic pressure in the wellbore is greater than pressure in the formation 64 all along the wellbore).

As another example, the fluid 78 can be selected so that hydrostatic pressures at certain locations along the wellbore 12 are less than respective predetermined maximum levels (e.g., less than a pressure rating of the casing shoe 76, less than a fracture pressure of the formation 64, etc.). The fluid 78 may be more dense or less dense as compared to the fluid 18. It is contemplated that, in most actual circumstances, the fluid 78 will be less dense as compared to the cement 120, but this is not necessary in keeping with the scope of this disclosure.

As used herein, the term "cement" is used to indicate a substance which is initially flowable, but which will harden into a rigid structure having compressive strength after being flowed into a well, thereby forming a barrier to fluid. Cement is not necessarily cementitious, and does not necessarily harden via hydration. Cement can comprise polymers (such as epoxies, etc.) and/or other materials.

Although the cement 120 is depicted in FIG. 6 as being placed entirely in the uncased section 12*b*, in other examples the cement could extend above the casing shoe 76, or could be placed entirely in the cased section 12*a*. Thus, the scope of this disclosure is not limited to any particular positions of interfaces between the fluids 18, 78, barrier substance 74 and/or cement 120.

It may now be fully appreciated that the above description of the various examples of the well system 10 and method 100 provides several advancements to the art of isolating flowable substances in a well. In one example described above, cement 120 can be prevented from flowing downward through another, lighter fluid 18.

A method of segregating flowable materials in conjunction with a subterranean well is described above. In one example, the method can include segregating flowable cement 120 from a first fluid 18 by placing a flowable barrier substance 74 between the cement 120 and the first fluid 18. The barrier substance 74 substantially prevents displacement of the cement 120 by force of gravity through the barrier substance 74 and into the first fluid 18.

The placing step can comprise flowing the barrier substance 74 into the well while the first fluid 18 is already present in the well. The placing step can also comprise flowing the cement 120 into the well after the step of flowing the barrier substance 74 into the well. The placing step can also comprise flowing the barrier substance 74 to a position above the first fluid 18.

The method may include placing a second fluid 78 above the cement 120. The second fluid 78 can have a density greater than, or less than, a density of the first fluid 18.

The barrier substance 74 may comprise a thixotropic gel and/or a gel which sets in the wellbore 12. The barrier substance 74 may have a viscosity greater than viscosities of the first and second fluids 18, 78. The cement 120 can have a density greater than a density of the first fluid 18.

Another method of segregating flowable materials in a wellbore 12 is disclosed to the art. In an example described above, the method can include flowing a barrier substance 74 into the wellbore 12 above a first fluid 18 already in the wellbore 12, and then flowing cement 120 into the wellbore 12 above the barrier substance 74.

A system 10 for use in conjunction with a subterranean well is also described above. The system 10 may include a flowable cement 120 isolated from a first fluid 18 by a flowable barrier substance 74 positioned between the cement 120 and the first fluid 18, whereby the barrier substance 74 substantially prevents displacement of the cement by force of gravity through the barrier substance 74 and into the first fluid 18.

The above disclosure describes a method 100 of controlling pressure in a wellbore 12. The method 100 can include placing a barrier substance 74 in the wellbore 12 while a first fluid 18 is present in the wellbore, and flowing a second fluid 78 into the wellbore 12 while the first fluid 18 and the barrier substance 74 are in the wellbore. The first and second fluids 18, 78 may have different densities.

The barrier substance 74 may isolate the first fluid 18 from the second fluid 78, may prevent upward migration of gas 80 in the wellbore and/or may prevent migration of gas 80 from the first fluid 18 to the second fluid 78.

Placing the barrier substance 74 in the wellbore 12 can include automatically controlling a fluid return choke 34, whereby pressure in the first fluid 18 is maintained substantially constant. Similarly, flowing the second fluid 78 into the wellbore 12 can include automatically controlling the fluid return choke 34, whereby pressure in the first fluid 18 is maintained substantially constant.

The second fluid 78 density may be greater than the first fluid 18 density. Pressure in the first fluid 18 may remain substantially constant while the greater density second fluid 78 is flowed into the wellbore 12.

The above disclosure also provides to the art a well system 10. The well system 10 can include first and second fluids 18, 78 in a wellbore 12, the first and second fluids having different densities, and a barrier substance 74 separating the first and second fluids.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A method of controlling pressure in a subterranean well, the method comprising:

forming a pressure control fluid column comprising first and second fluids separated by a barrier substance, wherein the barrier substance substantially prevents displacement of the second fluid by force of gravity through the barrier substance and into the first fluid; and maintaining pressure in the wellbore substantially constant during the forming.

2. The method of claim 1, wherein the forming comprises flowing the barrier substance into the well while the first fluid is already present in the well.

3. The method of claim 2, wherein the forming further comprises flowing the second fluid into the well after the flowing the barrier substance into the well.

4. The method of claim 1, wherein the forming further comprises flowing the barrier substance to a position above the first fluid.

5. The method of claim 1, further comprising placing a third fluid above the second fluid.

6. The method of claim 5, wherein the third fluid has a density greater than a density of the first fluid.

7. The method of claim 5, wherein the third fluid has a density less than a density of the first fluid.

8. The method of claim 1, wherein the barrier substance comprises a thixotropic gel.

9. The method of claim 1, wherein the barrier substance comprises a gel which sets in a wellbore.

10. The method of claim 1, wherein the barrier substance has a viscosity greater than a viscosity of the first fluid.

11. The method of claim 1, wherein the second fluid has a density greater than a density of the first fluid.

12. A method of segregating flowable materials in a wellbore, the method comprising:

flowing a barrier substance via a tubular conduit into the wellbore above a first fluid already in the wellbore;

then partially withdrawing the tubular conduit from the wellbore; and then flowing a second fluid into the wellbore above the barrier substance.

13. The method of claim 12, wherein the barrier substance substantially prevents displacement of the second fluid by force of gravity through the barrier substance and into the first fluid.

14. The method of claim 12, further comprising placing a third fluid above the second fluid.

15. The method of claim 14, wherein the third fluid has a density greater than a density of the first fluid.

16. The method of claim 14, wherein the third fluid has a density less than a density of the first fluid.

17. The method of claim 12, wherein the barrier substance comprises a thixotropic gel.

18. The method of claim 12, wherein the barrier substance comprises a gel which sets in a wellbore.

19. The method of claim 12, wherein the barrier substance has a viscosity greater than a viscosity of the first fluid.

20. The method of claim 12, wherein the second fluid has a density greater than a density of the first fluid.

21. A system for use in conjunction with a subterranean well, the system comprising:

a wellbore plug formed by a flowable cement isolated from a first fluid by a flowable barrier substance positioned between the cement and the first fluid, whereby the barrier substance substantially prevents displacement of the cement by force of gravity through the barrier substance and into the first fluid.

22. The system of claim 21, wherein the barrier substance is positioned above the first fluid.

23. The system of claim 21, further comprising a second fluid positioned above the cement.

24. The system of claim 23, wherein the second fluid has a density greater than a density of the first fluid.

25. The system of claim 23, wherein the second fluid has a density less than a density of the first fluid.

26. The system of claim 21, wherein the barrier substance comprises a thixotropic gel.

27. The system of claim 21, wherein the barrier substance comprises a gel which sets in a wellbore.

28. The system of claim 21, wherein the barrier substance has a viscosity greater than a viscosity of the first fluid.

29. The method of claim 21, wherein the cement has a density greater than a density of the first fluid.

* * * * *